United States Patent [19]

Weber et al.

[11] Patent Number: 4,616,783

[45] Date of Patent: Oct. 14, 1986

[54] CONSTANT FLOW ROTARY SPRAYING DEVICE

[76] Inventors: James R. Weber, R.R. 1, Box 268, Lacon, Ill. 61540; John R. Weber, 15905 N. Brougham Dr., Galena Knolls, Chillicothe, Ill. 61523

[21] Appl. No.: 640,512

[22] Filed: Aug. 13, 1984

[51] Int. Cl.[4] ..... B05B 1/28; B05B 3/08

[52] U.S. Cl. ..... 239/216; 239/222; 415/88

[58] Field of Search ..... 415/88; 239/215-218.5, 239/222

[56] References Cited

U.S. PATENT DOCUMENTS

| | | | |
|---|---|---|---|
| 1,185,939 | 6/1916 | Reed . | |
| 1,299,840 | 4/1919 | Lackey . | |
| 1,627,690 | 5/1927 | Denison . | |
| 1,864,797 | 6/1932 | Braemer . | |
| 2,013,639 | 9/1935 | Steinhart et al. . | |
| 2,023,710 | 12/1935 | St. Onge . | |
| 2,086,921 | 7/1937 | Norris . | |
| 2,099,988 | 11/1937 | Norris . | |
| 2,195,929 | 4/1940 | Klett . | |
| 2,251,457 | 8/1941 | Lee . | |
| 2,629,539 | 2/1953 | Drewes, Jr. . | |
| 2,999,646 | 9/1961 | Wagner . | |
| 3,004,717 | 10/1961 | Flury . | |
| 3,011,769 | 12/1961 | Umbricht . | |
| 3,074,650 | 1/1963 | Kanarek . | |
| 3,079,091 | 2/1963 | Anselmi . | |
| 3,125,296 | 3/1964 | Gold et al. . | |
| 3,181,796 | 5/1965 | Keller . | |
| 3,197,142 | 7/1965 | Gold et al. . | |
| 3,220,707 | 11/1965 | Weatherston et al. . | |
| 3,255,967 | 6/1966 | Kenney . | |
| 3,455,507 | 7/1969 | Ryder et al. | 239/215 |
| 3,749,313 | 7/1973 | Weitmann . | |
| 3,885,739 | 5/1975 | Tuttle . | |
| 3,891,149 | 6/1975 | Rendemonti . | |
| 4,176,793 | 12/1979 | Heinrich . | |
| 4,235,377 | 11/1980 | Davis et al. . | |
| 4,392,614 | 7/1983 | Groth et al. . | |

FOREIGN PATENT DOCUMENTS

| | | | |
|---|---|---|---|
| 847563 | 12/1939 | France | 239/215 |

*Primary Examiner*—Andres Kashnikow

*Attorney, Agent, or Firm*—Evan D. Roberts

[57] ABSTRACT

A spraying device for spraying liquid from a liquid supply is disclosed herein and includes a two stage pump system having first and second stage pumps, a reservoir with a liquid level control, pump and spray impeller, and a spray control chamber.

15 Claims, 12 Drawing Figures

FIG.1
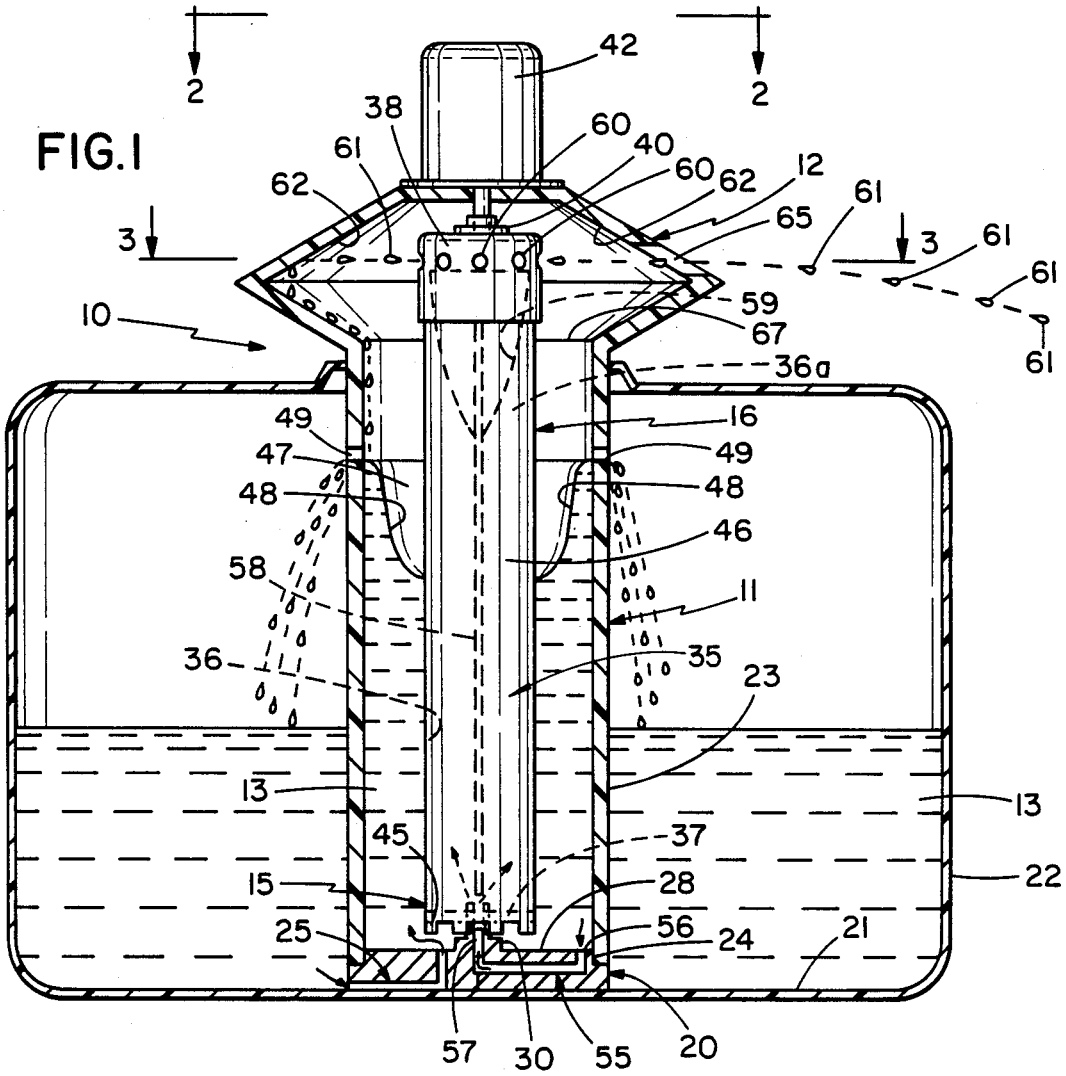
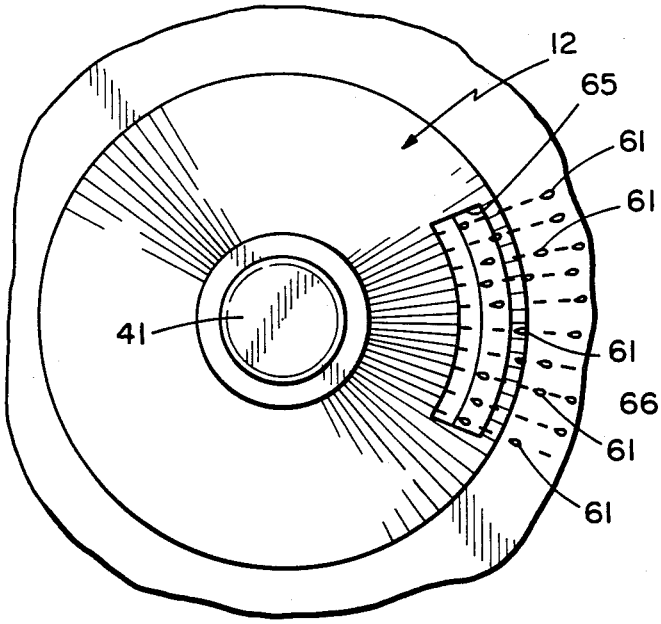
FIG.2
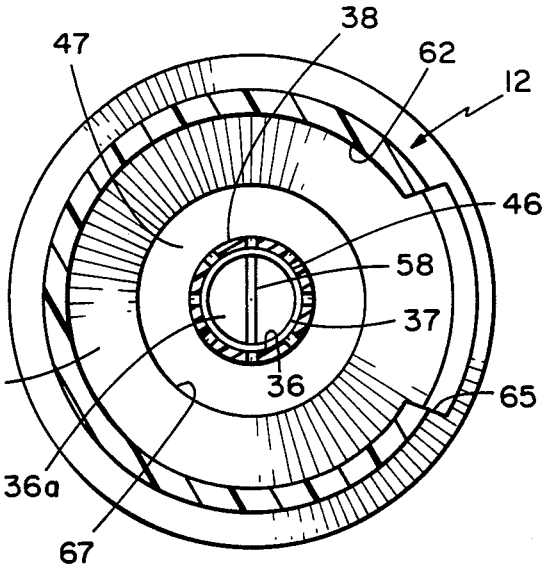
FIG.3

CONSTANT FLOW ROTARY SPRAYING DEVICE

BACKGROUND OF THE INVENTION

In known spraying devices, it is impossible to adequately control and minimize the complexity and cost of the apparatus; the quantity and rate of flow; the size of the droplets; the conservation of supply; the uniformity and pattern of spray; chemical spill, the effects of wind; and safety hazzards of utilization. The present invention provides a structure device that accomplishes the control and minimization of all of these parameters.

SUMMARY OF THE INVENTION

This invention relates to a spraying device for spraying liquid from a liquid supply wherein a two stage pump system is adapted to draw liquid from the liquid supply through a manifold by a first stage pump means into a reservoir wherein the level of liquid in the reservoir is controlled to provide a constant static head supply of liquid. A second stage of the two stage pump system pumps the liquid from the reservoir static head supply, elevates the liquid, and impells the liquid radially and horizontally outwardly within a control chamber. The control chamber has a discharge opening in the path of the impelled spray to allow only a predetermined quantity and pattern of the spray to flow out of said control chamber while the remaining impelled spray is retained by the control chamber and returned to the reservoir supply.

A primary object of this invention is to provide an efficient spray apparatus with a minimum complexity which could be economically and safely utilized for the lawn by the homeowner, as well as larger agricultural and industrial professional uses.

Another object of this invention is to provide a spraying device with a low volume but large droplet application to apply chemical spray in a uniform pattern at a constant flow rate.

A further object of this invention is to provide a spraying device which can be readily adapted to the rear of a small lawn tractor, for small applications, as well as to large equipment for large agricultural or industrial applications.

An additional object of this invention is to provide a spraying device wherein the spray pattern can be readily adjusted to accurately proximate the width of the mower, to spray the same area as that which is being mowed when the sprayer is attached to a mower.

Another object of this invention is to provide a spraying device with large droplets which can be sprayed at low proximity to the ground to minimize wind drift effects and to more accurately define the area to be sprayed.

Still another object of this invention is to provide a maximumly safe spray system by providing for a constant flow without requiring any pressurization of chemical spray and by minimizing the possibility of chemical spill of said spray.

An additional object of this invention is to provide a spraying device wherein the liquid is sprayed in a very efficient manner by very highly controllable large droplets and low volume spray and wherein excess spray is returned to the supply without waste.

Also, an object of this invention is to provide a spraying device which has a two stage pump system with a controlled static head reservoir of liquid source which provides a constant flow rate regardless of the fluid level in the main supply tank from which the reservoir is supplied and without requiring pressurization.

Other advantages and novel aspects of the invention will become apparent upon review of the following detailed description in conjunction with the accompanying drawings wherein:

FIG. 1 is a vertically sectioned elevation view of the spraying device of this invention showing the relationship of the liquid supply, two stage pump system, first and second stage pumps, and spray control chamber;

FIG. 2 is a top plan view taken along line 2—2 of FIG. 1 showing the discharge opening of the control chamber and droplets of spray impelled therethrough for controlling the spray;

FIG. 3 is a horizontal sectional view taken along line 3—3 of FIG. 1 showing the configuration of the control chamber, reservoir, chamber discharge opening and pump second stage vane structure;

Figure 10:
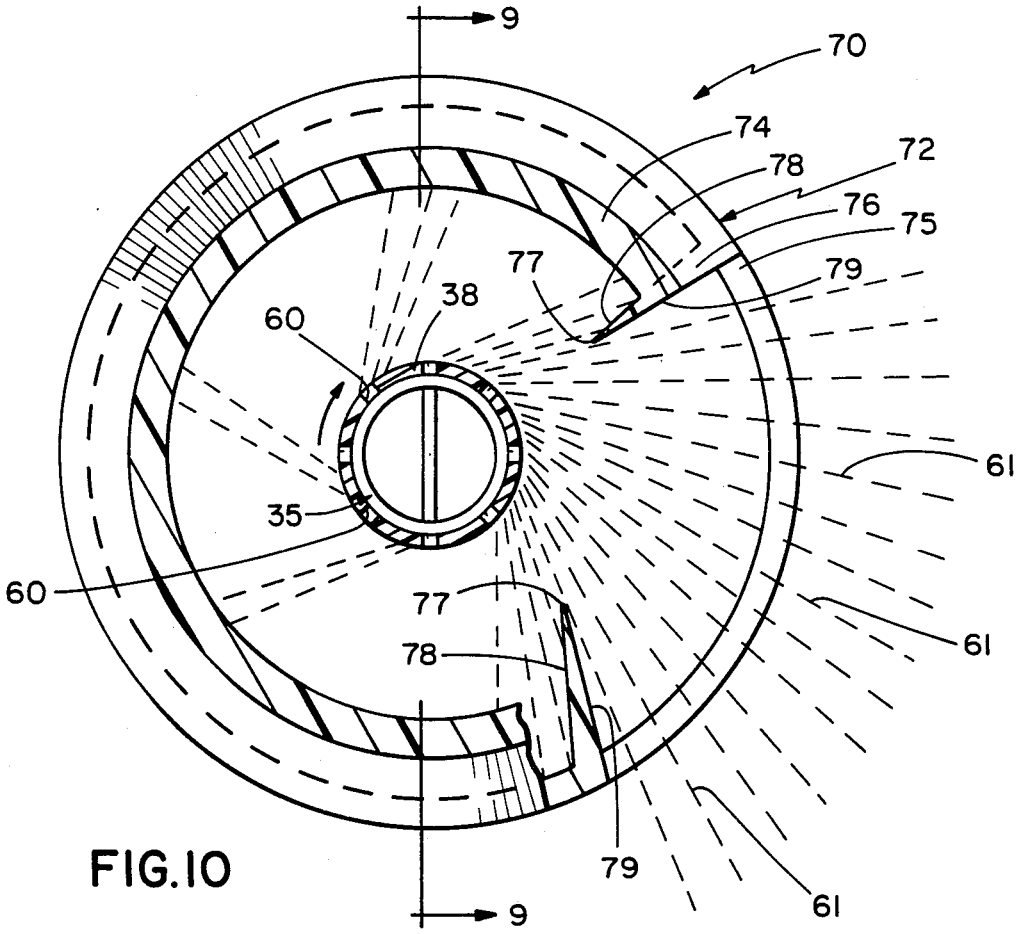
FIG. 10 is a partial section view taken along line 10—10 of FIG. 9 showing the vertical configuration of the oblique spray control separators positioned to direct unused spray back to the pump reservoir.
Figure 11:
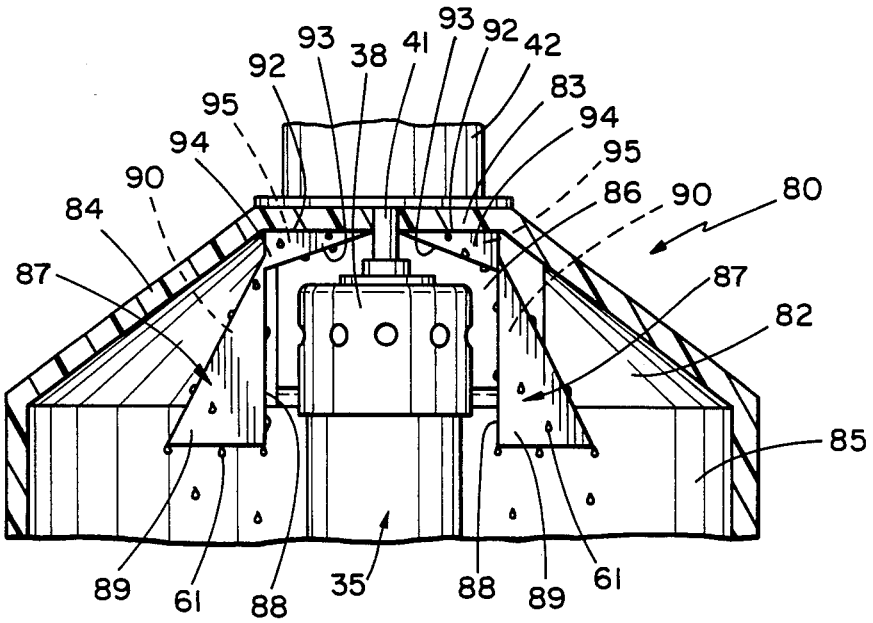
Figure 12:
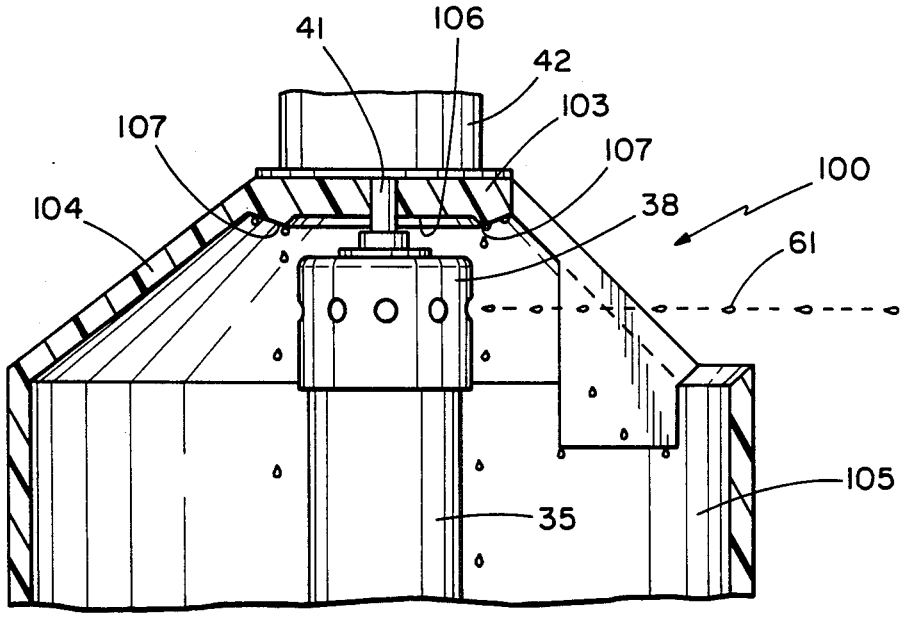

FIG. 11 is a partial section view of another modification of this invention taken along a line similar to line 9—9 of FIG. 10 showing a spray head control chamber having oblique spray control separators and a modified upper wall configuration contiguous therewith and adapted to direct the unused spray or miscellaneous droplets downwardly to the supply reservoir; and FIG. 12 is a partial section view of still another modification of this invention taken along a line similar to 9—9 of FIG. 10 showing a control chamber having oblique spray control separators and a modified upper wall configuration adapted to direct unused or miscellaneous spray droplets downwardly to the supply reservoir.

The spray device of this invention is broadly represented by the numeral 10 as shown by a first embodiment thereof (FIGS. 1–8) and includes generally a two stage pump system 11 and a spray head control chamber 12, and draws liquid from a general supply of liquid 13. Two stage pump system 11 (FIG. 1) includes, generally, a first stage pump 15 combined with a second stage pump 16.

First and second stage pumps 15 and 16 have a common manifold 20 (FIGS. 1 and 5–8) that is shown positioned on or near the bottom surface 21 of supply container 22 and forms a base for a tubular standpipe reservoir 23 rigidly attached thereto at 24. First stage pump 15 has a general manifold inlet passage system 25, in manifold 20, having a horizontal inlet 26 at or near the bottom of supply liquid 13 in supply container 22, and a vertical arcuate outlet passage 27 opening upwardly above manifold top surface 28. If manifold 20 is not on bottom 21, the entire space between manifold 20 and surface 21 will provide inlet to arcuate passages 27.

First and second stage pumps 15 and 16, respectively, (FIG. 1) also have a common rotating tubular vane element 35 (FIGS. 1, 3, 4 and 9–12). Vane element 35 has an inner wall surface 36 forming a cavity passage 36*a* sealed by a radial bearing plate 37 (FIGS. 1, 3 and 4) at the bottom thereof adjacent manifold 20 and by an impeller cap 38 at the top (FIG. 1). Radial vane bearing plate 37 has a bearing aperture surface 39 (FIG. 4) coaxial with the axis of vane element 35 to receive manifold bearing pintle 29, to rotatably mount the bottom of vane element 35 on bearing pintle surface 29, and against bearing thrust surface 30 at the bottom of vane element. Impeller cap 38 is provided with a coupling 40 to coaxially attach vane element to shaft 41 of rotating motor 42 secured to chamber 12 whereby rotation of motor 42 will rotate tubular vane element 35 within tubular standpipe 23.

First stage pump of two stage pump system (FIG. 1) also includes lower portion of vane element 35 which is provided with axially extending pump vanes 45 (FIGS. 1 and 4) adjacent peripheral surface 46 thereof. Pump vanes 45 are positioned over circumferentially arcuate outlets 27 of manifold outlet passage 25. Rotation of vane element 35 and its axially extending vanes 45 in proximity with the arcuate outlets 27 of general inlet passage 25 will draw liquid 13 from supply through passage into a reservoir 47, formed by standpoint 23.

Liquid 13 is thus impelled radially and circumferentially outwardly in reservoir 47 to create an elevated level of liquid 13 in tubular standpipe reservoir 47 to a substantially parabolic upper surface 48. Apertures 49 are provided in standpipe reservoir 47 whereby the parabolic level 48 of liquid 13 in reservoir 47 is controlled at the axial vertical location of apertures 49 by overflow of liquid 13, through apertures 49, into reservoir 47.

Second stage pump 16 of the second stage pump system 10 includes a general outlet passage system 55 (FIGS. 1 and 5–8) in manifold 20 having an inlet 56 from reservoir 47, and an outlet 57 axially through manifold bearing 27 into vane element cavity passage 36*a*. Vane cavity 36*a* is provided with a radial vane 58 longitudinally positioned therein.

Rotation of vane element 35 with its radial vane 58 acts to provide second stage pump 16 by drawing liquid 13 from reservoir 47 through passage 36*a*, radially and circumferentially outwardly and upwardly along longitudinal opening 36*a* of vane element to elevate liquid 13 therein upwardly to a parabolic-type upper surface 59 (FIG. 1). Radial apertures 60 (FIGS. 1 and 9) are circumferentially positioned in vane element cap 38 whereby elevated liquid 13 in vane element 35 will be impelled, as droplets 61, by the rotation of vane element 35, radially outwardly through said vane cap apertures 60 and away from vane element 35 toward upper conical wall 62 of chamber 12.

Wall 62 of chamber 12 (FIGS. 1, 3 and 9) is provided with a predetermined size aperture 65 whereby a predetermined amount and pattern of the impelled spray droplets 61 is allowed to pass from chamber 12 outwardly as a droplet spray 61 to the atmosphere. Remaining portion of impelled droplet spray 61 is impelled onto conical wall 62 and by gravity flows downwardly on lower conical wall 66 through upper reservoir opening 67 of tube 11 back into reservoir 47.

A first modification of a spray head control chamber 72 of this invention (FIGS. 9 and 10) is generally represented by the numeral 70. Motor 42 is mounted on a horizontal portion 73 of conical upper portion 74. Conical portion 74 extends downwardly directly to a tubular standpipe reservoir 69 which is larger in diameter than reservoir 47 of the previously described embodiment 10 of this invention, but is otherwise similar in shape and function. The other structures of this modification 70 of this invention are identical with that referred to with respect to FIGS. 1–8 and includes motor 42, as above set forth, attached to impeller cap 38 and tubular vane element 35 of the first and second stage pumps, 15 and 16, by shaft 41.

Aperture 75 (FIGS. 9 and 10) is provided in spray head chamber 72. Spray control members 76 are positioned obliquely to the path of spray droplets 61 (FIG. 10) adjacent vertical sides 75*a* of aperture 75. An acute or sharpened inner edge 77 is provied on members 76 by the intersection of an inner screening surface 78 and outer exhaust surface 79. The oblique positioning of members 76 and sharpened edge 77 of members 76 allows inner surface 78 to screen out unwanted droplets 61 and thereby prevent the impelling of miscellaneous droplets 61 onto outer exhaust surface 79. This prevents collection of droplets 61 externally to aperture 75, which would otherwise be wasted and contaminating to the exterior of the spray device of this invention.

A second modification of a spray head control chamber 82 (FIG. 11) of this invention is generally represented by the numeral 80. Motor 42 is mounted on a horizontal portion 83 of conical upper portion 84. Concal portion 84 extends downwardly directly to a tubular standpipe reservoir 85 which is larger in diameter than reservoir 47 of previously described embodiment 10 of this invention, but is otherwise similar in shape and function. The other structures of this modification 80 of this invention are identical with that referred to with respect to FIGS. 1–8 and includes motor 42, as above set forth, attached to impeller cap 38 and tubular vane element 35 of the first and second stage pumps, 15 and 16, by shaft 41.

Aperture 86 (FIG. 11) is provided in spray head chamber 82. Spray control members 87 are positioned obliquely in the path of spray droplets 61, as in FIG. 10, adjacent vertical sides of aperture 86. An acute or shapened inner edge 88 is provided on members 87 by an intersection of an inner screening surface 89 and an outer exhaust surface 90. The oblique positioning of members 87 and sharpened edge 88 of members 87 allows inner surface 88 to screen out unwanted droplets 61 and thereby prevent the impelling of miscellaneous droplets 61 onto outer exhaust surface 90. This prevents collection of droplets 61 externally to aperture 86 which would otherwise be wasted and contaminating to the exterior of the spray device of this invention.

Additionally, horizontal portion 83 is provided with downwardly extending spray control members 92 having an acute or sharpened edge 93 separating an inner surface 94 from exhaust surface 95. Members 92 provide horizontal screening of droplets in the same general manner as do members 76 and 77 in a vertical plane.

Another modification of a spray head control chamber 102 (FIG. 12) of this invention is generally represented by the numeral 100. Motor 42 is mounted on a horizontal portion 103 of a conical upper portion 104. Conical portion 104 extends downwardly directly to a tubular standpipe reservoir 105 which is larger in diameter than reservoir 47 of previously described embodiment 10 of this invention, but is otherwise similar in shape and function. The other structures of this modification 100 of this modification of this invention are identical with that referred to with respect to FIGS. 1–8 and includes motor 42, as above set forth, attached to impeller cap 38 and tubular vane element 35 of the first and second stage pumps, 15 and 16, by shaft 41.

Horizontal portion 103 is provided with a center concavity 106 terminating circumferentially downwardly at a downwardly extending circumferential edge 107. Any misdirected, or other miscellaneous spray against upper member 103 will be urged outwardly and downwardly to edge 107 and redirected into reservoir 105.

In operation, motor 41 is energized to rotate vane element 35 on pintle bearing 29, and liquid 13 is provided in supply container 22 to be utilized by the spray device 10 of this invention. As vane element 35 is rotated axially, vanes 45 of first stage pump 15 will draw liquid 13 from liquid supply container 22, through inlet 26 of general passage 25 of manifold 20 and upwardly and outwardly from outlet 27 thereof. The continued rotation of vane element 35 thus draws and drives liquid 13 and impells it radially and circumferentially outwardly and upwardly in reservoir 47 to elevate the drawn liquid 13 upwardly in reservoir tube 11.

Liquid 13 will continue to flow upwardly and circumferentially in tube 11 to form a parabolic upper surface level 48 that reaches radial apertures 49 circumferentially positioned therearound. Reservoir liquid 13 will be expelled, by overflow, through apertures 49, thus limiting and specifically controlling the depth of liquid supply 13 in reservoir 11. Thus, a fixed static head pressure of liquid 13 will be provided thereby in reservoir 11 as a first stage in the two-stage pump system 10 of the spraying device 10 of this invention.

Continued rotation of motor 41 (FIG. 1) will cause continued rotation of vane element 35 of second stage pump 16 (FIGS. 1, 3 and 4) whereby vertical internal vane 58 will rotate and draw liquid 13 from reservoir 47 through inlet 56 of general outlet passage 55, and upwardly and out through outlet passage 57 of vane bearing spindle 29. Continued rotation of vane element 35 by motor 42 will cause liquid 13 to be impelled radially and circumferentially outwardly and upwardly within the cavity **36*a* formed by wall 36 of vane element 35 to elevate liquid 13 upwardly with an upper parabolic surface portion 59 reaching radial apertures 60 of vane element cap 38**.

Centrifugal force of the outward and upward urging of liquid 13 within vane element 35 will cause liquid 13 to be impelled radially outwardly through cap apertures 60, as spray droplets, toward and against conical chamber surface 62. Aperture 65 in chamber wall 62 allows a predetermined amount and pattern of spray 61 to be impelled from chamber 12 as a spray to the atmosphere. Spray not released by opening 65 is captured by conical surface 62 (FIG. 1) of said chamber 12. Gravity causes the captured spray 61, in chamber 12, to flow downwardly along lower conical surface 66, through upper opening 67 of tube 11 and back into reservoir 47 to thus be recycled as part of reservoir supply of liquid 13.

Figure 4:
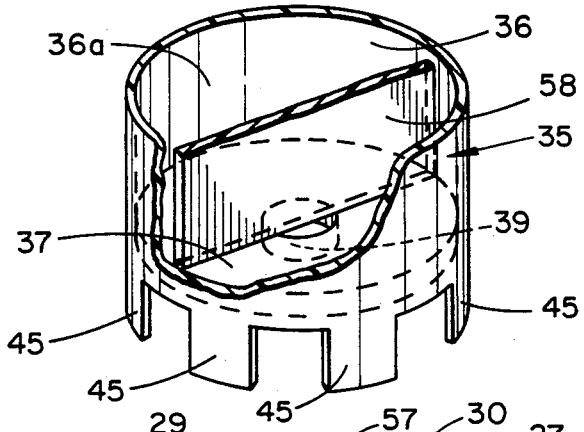
FIG. 4 is a partially sectioned perspective view of the impellers of the first stage pump and the vane impeller of the second stage pump.
Figure 5:
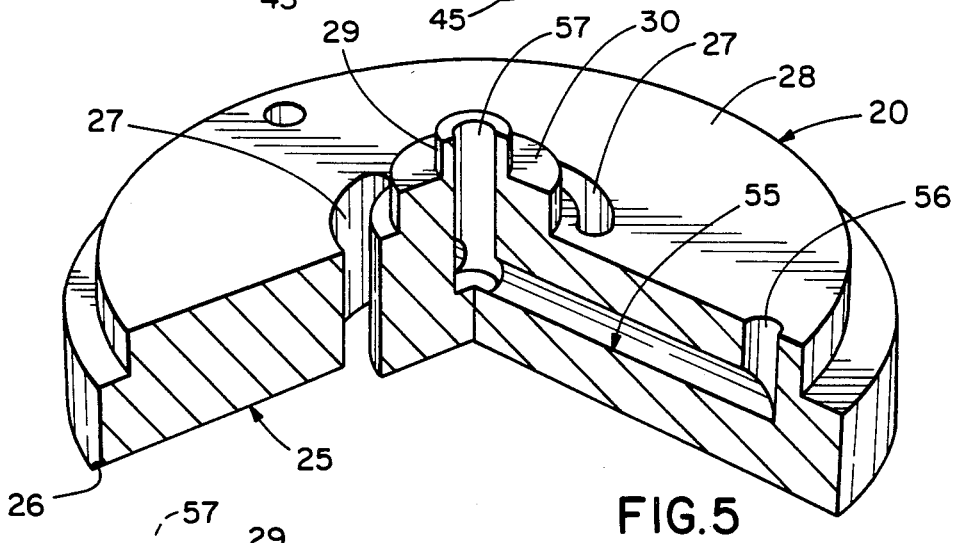
FIG. 5 is a biradially sectioned view of a pump manifold of this invention taken along line 5—5 of FIG. 7 showing the inlet and outlet passages, as well as a center bearing to rotatably support the pump vane member.
Figure 6:
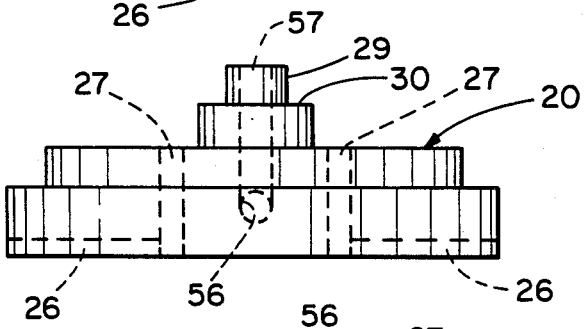
FIG. 6 is a side elevation view of the manifold of the invention showing the configuration thereof, the vane bearing and the arrangement of inlet and outlet passages thereof.
Figure 7:
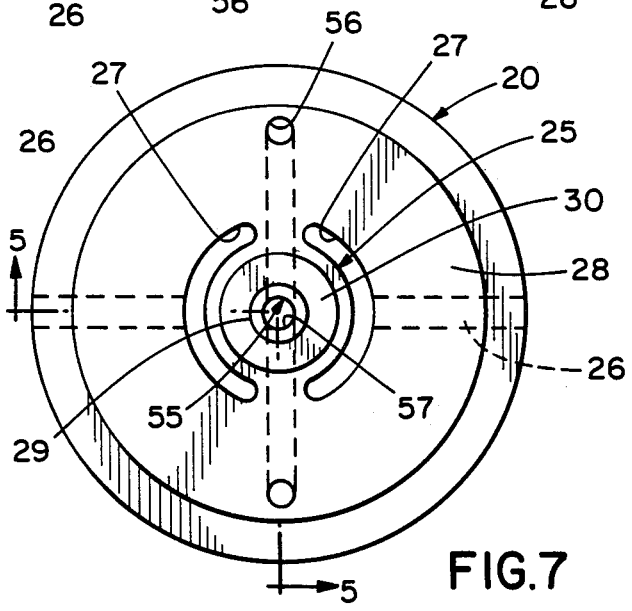
FIG. 7 is a top plan view of the manifold of the invention showing the configuration thereof, the vane bearing, and the arrangement of inlet and outlet passages thereof.
Figure 8:
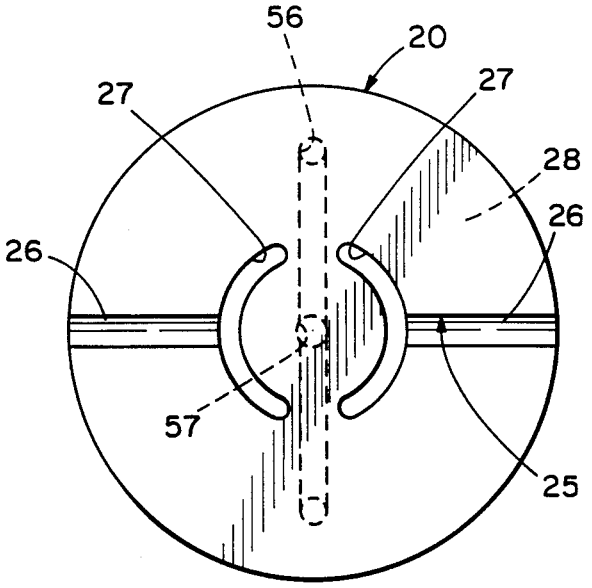
FIG. 8 is a bottom plan view of the manifold of the invention showing the configuration thereof, and arrangement of inlet and outlet passages thereof.
Figure 9:
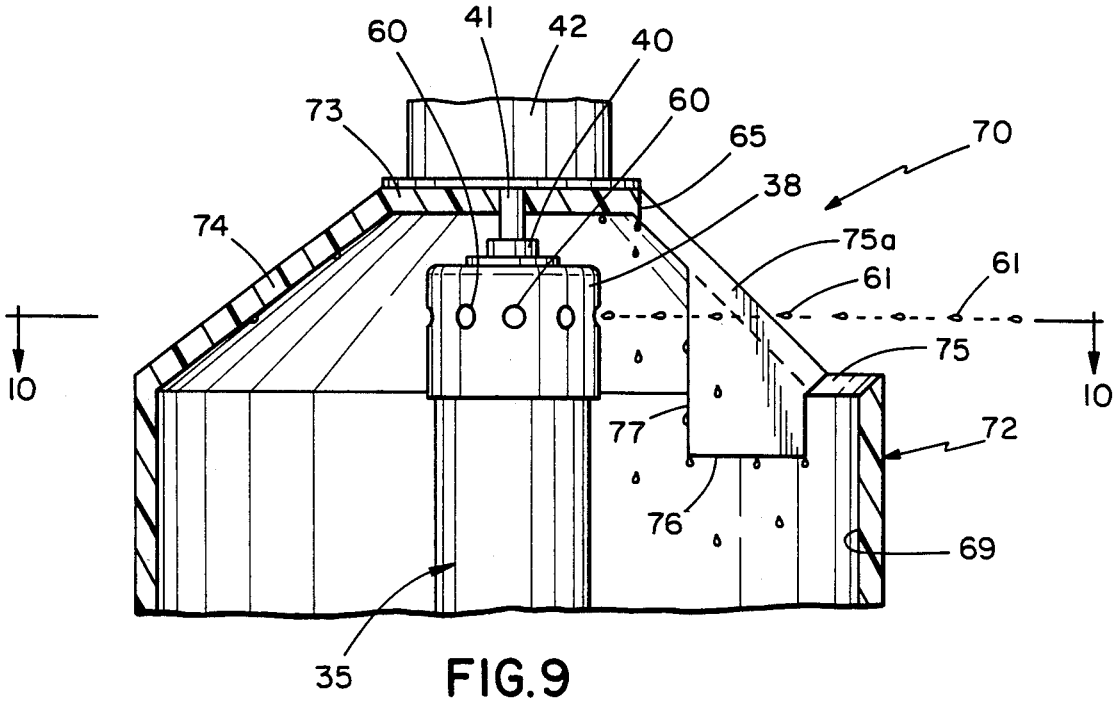
FIG. 9 is a partial section view taken along line 9—9 of FIG. 10 of a second embodiment of this invention showing a modified spray head control chamber having oblique spray control separators.

The operation of chamber 12 (FIG. 1), and particularly, spray control provided by aperture 65 thereof, can be modified to provide even more accurate control over the quantity, pattern and efficiency of spray 61 by virtue of the spray control members 76, 87 and 92 (FIGS. 9, 10 and 11). In particular, as spray 61 is impelled through a chamber aperture such as 75 (FIGS. 9 and 10), the acute edge 77 separating screening surface 78 and exhaust surface 79 of spray control members 76 will definitively, by surface 78 and edge 77 thereof, screen unwanted and miscellaneous spray droplets 61 and shield external exhaust surfaces 79 therefrom.

The shielded position of exhaust surfaces 79, of spray control members 76, will preclude droplets 61 from impinging on an external surface 79, and accordingly, only a predetermined quantity and pattern of spray droplets 61 will be emitted from a chamber such as 72 (FIGS. 9 and 10) without waste or external contamination thereof, under the control of spray control members 76.

Similarly (FIG. 11), vertical spray control members 87 imposing a separating edge 88 between respective inner screening surfaces 89 and respective shielded exhaust surfaces 90 operate in combination with inclined horizontal spray control members 92 with their respective acute screening edges 93, internal screening surfaces 94 and shielded exhaust surfaces 95 to vertically and horizontally screen and control the quantity and pattern of spray droplets 61 otherwise emanating from apertures 60 of rotating impeller vane cap 38. It should be noted that the screened droplets 61 impinged upon horizontal screening surfaces 89 and 94 will, by gravity, drain back into reservoir 85 for recycling as part of fluid supply 13.

In regard to the operation of modification illustrated by FIG. 12, it should be noted that during operation, there is a possibility of miscellaneous lateral splashing or miscellaneously directed droplets that would impinge upon or otherwise be collected on upper surface 106 of upper member 103. These droplets will, by virtue of the downwardly extended circumferential edge 107, be directed downwardly into reservoir 105 to be recycled with supply liquid 13.

It is to be understood that the invention is not to be limited to the specific constructions and arrangements shown and described, as it will be understood to those skilled in the art that certain changes may be made without departing from the principles of the invention.

What is claimed is:

1. A spraying device for spraying droplets of liquid from a liquid supply comprising a two stage pump system, and a spray control chamber, said two stage pump system having a manifold with a first stage inlet passage system and a second stage outlet passage system, said first stage of said pump system having a reservoir and a first stage pump interconnecting said liquid supply with said reservoir by said manifold first stage inlet passage system for directing and controlling the flow of liquid drawn therethrough by said first stage pump from said supply and into said reservoir, said reservoir having a liquid level control means for maintaining a predetermined level of liquid therein to provide a predetermined static liquid pressure in said reservoir, said second stage of said pump system having a second stage pump interconnecting said reservoir with said chamber by said manifold second stage outlet passage system for directing and controlling the flow of liquid drawn therethrough by said second stage pump from said pump reservoir supply and rotatably impelling said liquid in droplets away from said second stage pump within said spray control chamber and against the walls thereof, said spray control chamber having a discharge opening in the path of said impelled spray droplets for allowing a predetermined quantity and pattern flow of said impelled liquid from said chamber as a droplet spray.

2. A spraying device for spraying liquid from a liquid supply as defined in claim 1 wherein said spray control chamber discharge opening has two opposite sides longitudinally disposed to the axis of said second stage pump, and has inwardly extending partitions respectively adjacent said longitudinal sides for limiting the scope of said spray and for screening excess spray from said chamber discharge opening to prevent miscellaneous contaminating spray from being impelled through said opening.

3. A spraying device for spraying liquid from a liquid supply as defined in claim 2 wherein said partitions extend obliquely to spray being impelled from said control chamber from said second stage pump and having an inner surface to screen and direct said miscellaneous spray back to said reservoir.

4. A spraying device for spraying liquid from a liquid supply as defined in claim 1 wherein said reservoir comprises a tubular standpipe submersed in said liquid supply, said manifold first stage inlet passage sytem having an outlet opening thereof opening into the radial inward portion of said reservoir for directing the interconnection between said supply and said reservoir to the radially inner portion of said reservoir, and said manifold as a second stage passage outlet system opening for interconnection of said reservoir and said second stage pump whereby said first and second stage pumps will respectively pump liquid from said supply to the inner portion of said reservoir in a directed and controlled manner and from said reservoir to said chamber.

5. A spraying device for spraying liquid from a liquid supply as defined in claim 1 wherein said first stage pump has a tubular rotating pumping element with the axis thereof longitudinally positioned within said reservoir and having pumping vanes rotated therewith within said reservoir adjacent said first stage inlet conduit opening to draw liquid from said supply through said inlet and to impell said liquid circumferentially and radially outwardly against the wall of said reservoir whereby the level of liquid in said reservoir will tend to continuously raise generally upwardly and more greatly adjacent said wall.

6. A spraying device for spraying liquid from a liquid supply as defined in claim 4 wherein said second stage pump comprises a rotating vane element tube mounted within said reservoir and adapted to axially rotate therein, said vane element tube having a vertical vane therein adapted for urging said liquid circumferentially and radially outwardly to draw liquid from said reservoir upwardly and outwardly therethrough, said vane element tube having one or more circumferential openings therethrough in said chamber to impellingly release said liquid therefrom against the walls of said chamber.

7. A spraying device for spraying liquid from a liquid supply as defined in claim 4 wherein said first stage pump has a tubular rotating pumping element with the axis thereof longitudinally positioned within said reservoir and having pumping vanes rotated therewith within said reservoir adjacent said first stage inlet conduit opening to draw liquid from said supply through said inlet and to impell said liquid circumferentially and radially outwardly against the wall of said reservoir whereby the level of liquid in said reservoir will tend to continuously raise generally upwardly and more greatly adjacent said wall, said second stage pump comprises a rotating vane element tube mounted within said reservoir and adapted to axially rotate therein, said vane element tube having a vertical vane therein adapted for uging said liquid circumferentially and radially outwardly to draw liquid from said reservoir upwardly and outwardly therethrough, said vane element tube having one or more circumferential openings therethrough in said chamber to impellingly release said liquid therefrom against the walls of said chamber.

8. A spraying device for spraying liquid from a liquid supply as defined in claim 7 wherein said first stage pump tubular pumping element and said second stage pump rotating vane element are one continuous tubular element.

9. A spraying device for spraying liquid from a liquid supply as defined in claim 8 wherein said manifold comprises the base of said standpipe and a bearing within said reservoir and otherwise seals said reservoir from said supply, said first and second stage continuous tubular element is axially rotatably mounted on said manifold bearing at one end and in said chamber at the other end.

10. A spraying device for spraying liquid from a liquid supply as defined in claim 4 wherein said first stage pump has a tubular rotating pumping element with the axis thereof longitudinally positioned within said reservoir and having pumping vanes rotated therewith within said reservoir adjacent said first stage inlet conduit opening to draw liquid from said supply through said inlet and to impell said liquid circumferentially and radially outwardly against the wall of said reservoir whereby the level of liquid in said reservoir will tend to continuously raise generally upwardly and more greatly adjacent said wall.

11. A spraying device for spraying liquid from a liquid supply as defined in claim 1 wherein said second stage pump comprises a rotating vane element tube mounted within said reservoir and adapted to axially rotate therein, said vane element tube having a vertical vane therein adapted for urging said liquid circumferentially and radially outwardly to draw liquid from said reservoir upwardly and outwardly therethrough, said vane element tube having one or more curcumferential openings therethrough in said chamber to impellingly release said liquid therefrom against the walls of said chamber.

12. A spraying device for spraying liquid from a liquid supply as defined in claim 1 wherein said first stage pump has a tubular rotating pumping element with the axis thereof longitudinally positioned within said reservoir and having pumping vanes rotated therewith within said reservoir adjacent said first stage inlet conduit opening to draw liquid from said supply through said inlet and to impell said liquid circumferentially and radially outwardly against the wall of said reservoir whereby the level of liquid in said reservoir will tend to continuously raise generally upwardly and more greatly adjacent said wall, said second stage pump comprises a rotating vane element tube mounted within said reservoir and adapted to axially rotate therein, said vane element tube having a vertical vane therein adapted for urging said liquid circumferentially and radially outwardly to draw liquid from said reservoir upwardly and outwardly therethrough, said vane element tube having one or more circumferential openings therethrough in said chamber to impellingly release said liquid therefrom against the walls of said chamber.

13. A spraying device for spraying liquid from a liquid supply as defined in claim 1 wherein said chamber having walls tapered outwardly and downwardly to deflect unimpelled liquid downwardly and back into said reservoir.

14. A spraying device for spraying liquid from a liquid supply as defined in claim 1 wherein said reservoir comprises a tubular standpipe submersed in said liquid supply, said manifold first stage inlet passage system having an opening thereof opening into said reservoir for interconnection between said supply and said reservoir, and said manifold second stage passage outlet system has an opening for receiving fluid from the radially outward position of said reservoir and opening into the inner portion of said second stage pump for directing the interconnection of said reservoir and said second stage pump to the radially inner portion of said second stage pump whereby said first and second stage pumps will respectively pump liquid from said supply to said reservoir and from the outer portion of said reservoir to the inner portion of said second stage pump in a directed and controlled manner.

15. A spraying device for spraying liquid from a liquid supply as defined in claim 14 wherein said manifold second stage passage outlet system has an opening for receiving fluid from the radially outward portion of said reservoir and opening into the inner portion of said second stage pump for directing the interconnection of said reservoir and said second stage pump to the radially inner portion of said second stage pump whereby said first and second stage pumps will respectively pump liquid from said supply to the inner portion of said reservoir to the inner portion of said second stage pump in a directed and controlled manner.

* * * * *

UNITED STATES PATENT AND TRADEMARK OFFICE

CERTIFICATE OF CORRECTION

PATENT NO. : 4,616,783

DATED : OCTOBER 14, 1986

INVENTOR(S) : JAMES R. WEBER & JOHN R. WEBER

It is certified that error appears in the above-identified patent and that said Letters Patent is hereby corrected as shown below:

Colume 3 Line 39 "standpoint" should be --standpipe--;

Colume 7 Line 36 "as" should be --has--; and

Colume 8 Line 12 "uging" should be --urging--.

Signed and Sealed this

Twenty-fourth Day of March, 1987

*Attest:*

DONALD J. QUIGG

*Attesting Officer*

*Commissioner of Patents and Trademarks*